United States Patent [19]

Charpentier

[11] 4,176,335

[45] Nov. 27, 1979

[54] ELECTRICAL CONDUCTING APPARATUS

[75] Inventor: Douglass E. Charpentier, Pasadena, Calif.

[73] Assignee: Burroughs Corporation, Detroit, Mich.

[21] Appl. No.: 845,120

[22] Filed: Oct. 25, 1977

[51] Int. Cl.[2] ..... H01F 27/28

[52] U.S. Cl. ..... 336/180; 336/223

[58] Field of Search ..... 336/180, 181, 182, 183, 336/223, 222, 84 C, 84 R, 232, 82, 192

[56] References Cited

U.S. PATENT DOCUMENTS

| | | | |
|---|---|---|---|
| 2,246,167 | 6/1941 | D'Entremont | 336/223 X |
| 2,539,400 | 1/1951 | Camras | 336/223 X |
| 2,580,208 | 12/1951 | Wiengand | 336/223 X |
| 2,641,682 | 6/1953 | McKenna | 336/223 X |
| 2,855,576 | 10/1958 | Rohatyn | 336/223 UX |
| 2,882,507 | 4/1959 | Holz | 336/223 |
| 3,826,967 | 7/1974 | Wilkinson et al. | 336/223 X |
| 3,886,510 | 5/1975 | Canup et al. | 336/223 X |

*Primary Examiner*—Thomas J. Kozma

*Attorney, Agent, or Firm*—Alfred W. Kozak; Nathan Cass; Kevin R. Peterson

[57] ABSTRACT

An electrical conducting apparatus comprising an envelope, or in an alternative embodiment, a brother-pair of envelopes, in which said envelope encompasses a magnetic field whereby fluctuations in the magnetic field may be sensed or tapped-off by two half-turn type conducting circuits. The conducting envelope provides a cross-sectional area for encompassing the magnetic field and has a longitudinal severance line or slit which divides the envelope into two sections symmetrical to each other. At a location of 180° from the severance line is a center-tap terminal, while two output terminals are provided on each side of the severance line thus to provide two half-turn winding circuits in relationship to the center-tap terminal. Useful configurations of said envelope may include a rectangular shape, a tubular shape, a spiral shape, which may be arranged into symmetrical pairs of envelopes which are oriented at a 180° relationship to each other to form a brother-pair of two sets of two half-turn windings having a center tap.

6 Claims, 10 Drawing Figures

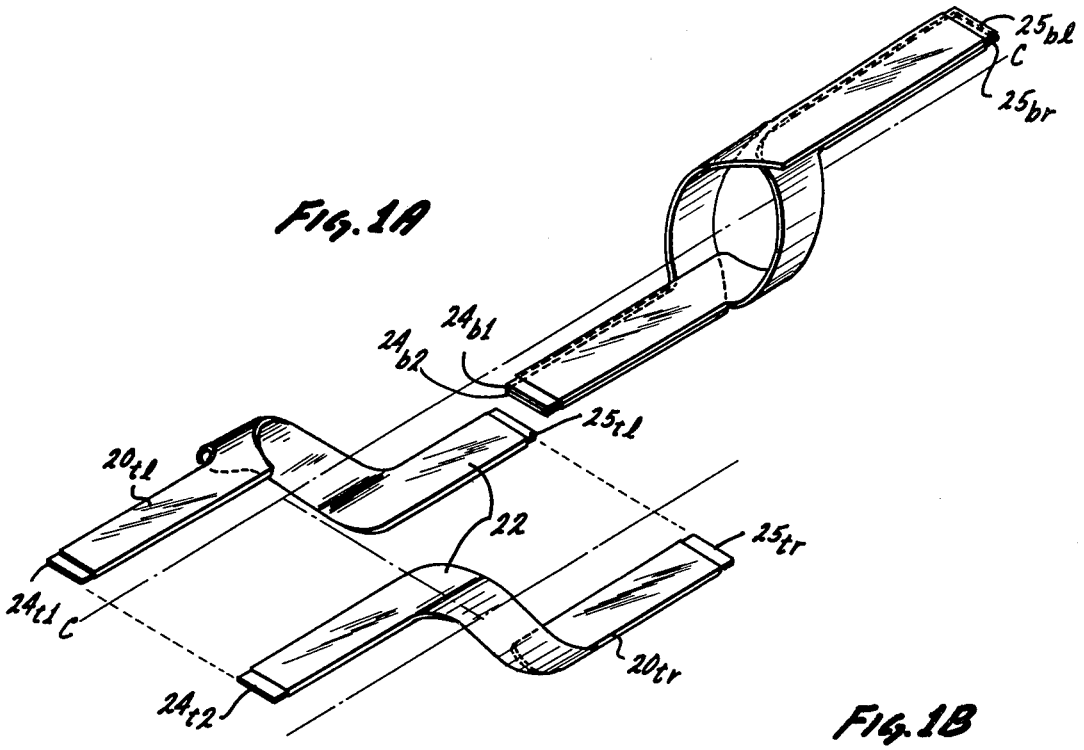
FIG. 1A
FIG. 1B
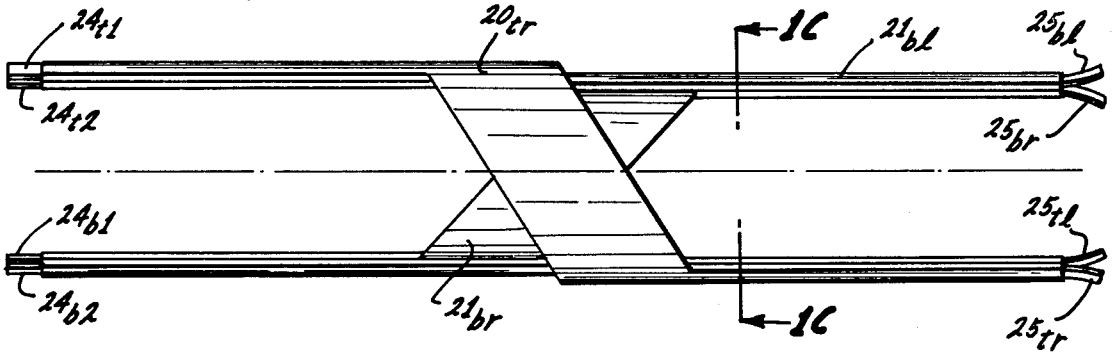
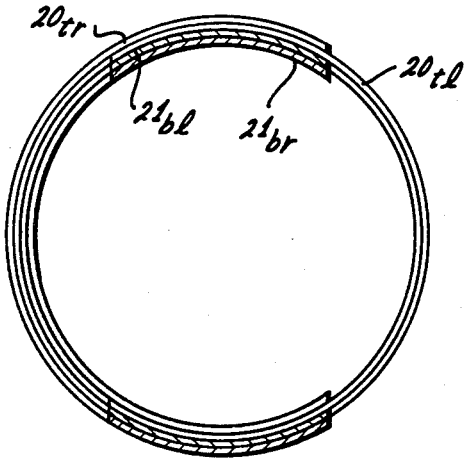
FIG. 1C

ELECTRICAL CONDUCTING APPARATUS

FIELD OF THE INVENTION

This invention relates to special types of electrical apparatus for encompassing varying magnetic fields whereby output circuitry is provided for current pickup at lower voltages than would ordinarily occur

CROSS REFERENCES TO RELATED APPLICATIONS

This application is related to the below-mentioned applications filed on even date and entitled; "Low Voltage High Current Transformer," inventor Douglass Charpentier, Ser. No. 845,060, filed Oct. 25, 1977, now U.S. Pat. No. 4,159,457 and "Secondary Circuit For Power Transformer," inventor Douglass E. Charpentier, Ser. No. 845,118, filed Oct. 25, 1977. Each of these applications is assigned to the same common assignee.

BACKGROUND OF THE INVENTION

Often times for instrumentation or electrical current development purposes, a varying magnetic field is encompassed in order to develop a resultant current at a low voltage in order to do work or for measurement purposes. One typical usage may be with high current output transformers. Conventionally, a transformer is constructed of a core formed of magnetic material which will then have two or more coils or windings positioned thereon to form a primary or input winding in a secondary or output winding. The windings are interlinked by the magnetic flux passing through the magnetic circuit formed by the core. The general rule, here, is that the voltage output of the secondary winding will be a proportion of the voltage of the input or primary winding according to a proportion determined by the ratio of the number of turns of secondary winding to the number of turns of the primary winding.

There are certain applications, especially in the peripheral, computer and welding fields that require very low but precise output voltages to be provided while at the same time permitting extremely large current flows.

One commonly used standard magnetic core form is the E-I transformer core. In order to develop low output voltage from the secondary winding of such a transformer, it has often been tried to use a pair of half-turn windings by making a single turn of wire around the center leg of the core and center tapping this wire to ground in order to form two half-turn windings, one on each side of the center-tap. This, however, had the disadvantage in that if the current load on one half-turn of the secondary winding did not match the load on the other half-turn of the secondary winding then the regulation of the transformer was higly inadequate since the leakage reactance of the more heavily loaded half-turn secondary was much larger than the leakage reactance of a secondary winding which consisted of a full-turn.

Due to the leakage reactance in the case of the two one half-turn secondary windings, the voltage across the "loaded" half-turn secondary winding tends to decrease while the voltage across the other half-turn secondary winding tends to increase, thus causing poor voltage regulation.

In an E-I core transformer when it is desired to produce extreme voltage step-down, the secondary winding normally must be at least one-full turn, and any attempt to carry current out of only one half-turn through the window of E-I core, will divert the core magnetic flux to the opposite outer core leg, and this will severely limit the available load current.

If this limitation could be overcome, there would be needed only one-half the length of conductor for a given voltage output, thus reducing the cost of the conductor material and at the same time reducing the operation $I^2R$ heat loss in the conductor. Thus, at a given voltage and load current requirement, a "half-turn secondary" would operate at one half the turns per volt of the normal one turn secondary. Further, this would require only one-half the primary turns that would be required in the normal design, thus reducing its material content and heat loss similarly.

Normally, the price paid is that with the "half-turn" secondary, the core material must operate at twice the flux density, but today with modern power ferrite cores which are designed to carry high flux density, this is no longer a problem.

Even more useful today, with the use of switching inverter applications, the high frequency switching of the switching inverters help to reduce the actual core flux density operating with the transformer.

SUMMARY OF THE INVENTION

The electrical apparatus dislcosed herein provides configurations for encompassing varying magnetic fields while yet providing low impedance output paths responsive to those fields in a fashion where the induced voltage is desired to be much lower than what would occur from a single-loop type conductor which is normally used.

One of the most convenient illustrations for use of such electrical apparatus is in conjunction with transformers of the type providing low voltage output and high current capacity discussed hereinbelow.

The aforementioned problems in providing a low output voltage with high current capability while simultaneously diminishing the size of the primary windings and the secondary windings permitting reduction of the volume of spaced required, the reduction of $I^2R$ losses, and reduction of the leakage reactance, are efficiently handled by the elements of the present invention.

A magnetic circuit flux path is provided by a ferromagnetic core of laminated or of ferrite magnetic material, whereby the two outer legs of an E-I core provide return paths. The central leg is encompassed by a set of primary windings connected in series and also by a pair of envelope conductors forming four half-turn windings. Two of said half-turn windings operate in one phase while being connected to the other remaining two half-turn windings operating 180° from the first phase. The central leg of the magnetic core is enclosed by, but insulated from, an electrically conductive envelope which forms two half-turn secondary windings and a center-tap terminal. A second envelope of electrically conductive material forming two secondary half-turn windings and a center-tap, encloses, but is insulated from, the first envelope.

Each envelope, consisting of two half-turn secondary windings and a center-tap, is made of metallic electrically conductive material shaped to encompass the central leg. Pairs of such envelopes are oriented 180° transversely to each other to form a "brother-pair." Each envelope has a longitudinal gap or separation astride which there extends two output terminals. At a position 180° from the longitudinal gap of the output terminals, each envelope has a center-tap terminal leg.

Several types of configurations of secondary conductors may be employed to suit various purposes.

The secondary conductors permit the construction of a low voltage high current transformer in which the primary winding encircles the central leg and the envelopes which form the secondary conductors. The primary winding may also also be constructed of half-section windings in which one portion of the primary winding encompass only the central core-leg while the other half portion of the primary windings encompass the central leg and the envelopes.

The transformer and its secondary conductor configurations may be advantageously embodied to form a low voltage high current power supply of the AC variety of the DC variety with the use of rectification means. Another form of power supply may advantageously be used with high frequency switching inverters to provide a low voltage regulated power supply with high current output.

BRIEF DESCRIPTION OF THE DRAWINGS

The elements and intercooperative principles of the present invention can be better understood by reference to the following drawings in which:

FIGS. 1A, 1B, 1C show three views of a double spiral type of secondary conductor;

DESCRIPTION OF PREFERRED EMBODIMENT

Figure 1:
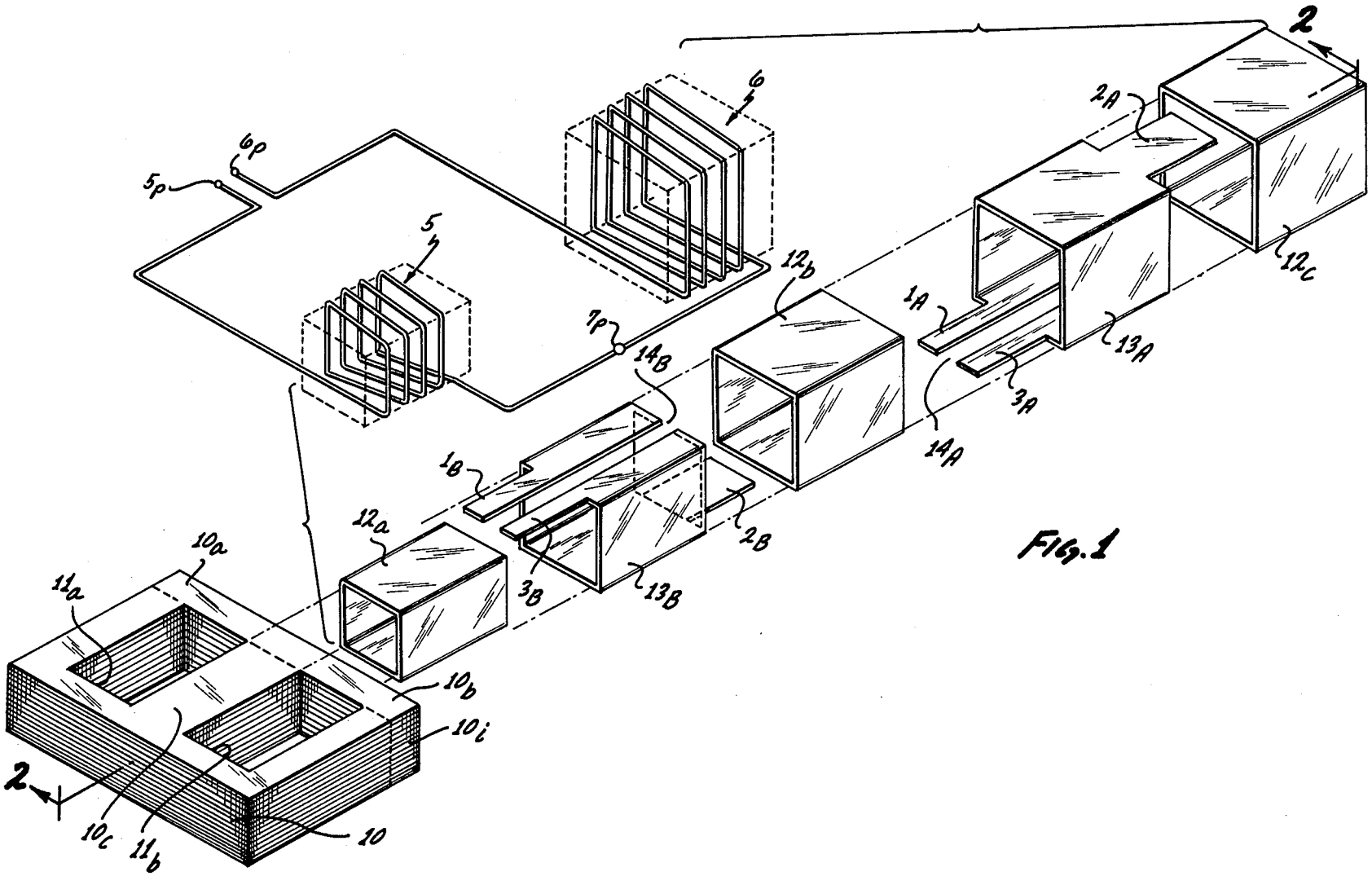
FIG. 1 represents an exploded view of the various elements of a half-turn transformer shown separated in logical alignment.

A preferred embodiment of secondary conductors in a low voltage, high current transformer, with the half-turn winding configuration is shown in a preferred embodiment in FIG. 1 which illustrates in an exploded view how the primary windings, the secondary windings, core and insulators are configured and arranged thus to permit two or more simply constructed one half-turn secondary conductors. These arrangements have the effect of permitting a very low voltage, high current capacity output, while at the same time reducing by one-half the number of turns required on the primary windings and, in addition, accomplishing a very high ratio of step-down effect.

Referring to FIG. 1, a standard laminated E-core 10 is provided with a shunt bar or I-bar $10_i$, to provide a closed magnetic flux path through a central leg $10_c$ and a first and second outer leg $10_a$ and $10_b$, which includes two window areas $11_a$ and $11_b$.

The core 10 may be fabricated of EI sections or of double E core sections which come in a standard type and which are made of a plurality of insulated laminations of ferromagnetic material or ferrite of a high permeability type.

The central leg $10_c$ of the core 10 is covered by an insulator tube $12_a$ which may be of high grade paper, plastic or other insulating material. Around the insulator tube $12_a$ there is wound one-half of the primary turns 5 which connect from point $5_p$ to point $7_p$. These turns 5 are wound in conventional fashion and wrapped with a sheet of insulation $5_n$. Likewise turns 6 are covered with insulation $6_n$.

About the central leg $10_c$ with its insulator $12_a$ and the insulated half-primary 5, there is placed a "secondary conductor" $13_B$ which will form a first pair of half-turn secondary windings. The secondary conductor $13_B$ may be made of sheet copper or other electrical conducting material and is formed to envelop the insulator tube $12_a$ and its insulated winding 5 in a fashion whereby a slit $14_B$ longitudinally separates the secondary conductor $13_B$ into two equal areas. Alternately, the slit $14_B$ may be a severance line with overlapping edges but whereby insulation is used preventing any possibility of electrical contact between the several edges.

The secondary conductor $13_B$ forms an envelope having an extension conductor or terminal $2_B$ to make a center-tap output leg. The top face or upper portion of the envelope of secondary conductor $13_B$ is formed to provide two output connection legs or terminals, $1_B$ and $3_B$, which are separated by the longitudinal slit $14_B$. Alternatively the edges of slit $14_B$ may constitute an overlapping set of edges which are insulated from each other.

As will be seen hereinafter in connection with FIG. 4, the effect of the secondary conductor envelope $13_B$ is to provide two one-half turn conducting paths which envelop the central leg $10_c$. These two half-turn conducting paths are formed by the terminal legs $1_B$ and $3_B$ with the center-tap terminal leg $2_B$ (FIG. 1). As will be discussed hereinafter, another secondary conductor envelope $13_A$ is placed around secondary conductor $13_B$ to form another pair of half-turn windings as will also be seen in FIG. 4. The pair of half-turn windings of envelope $13_B$ and the pair of half-turn windings of envelope $13_A$ may be called a "brother-pair" of envelopes which form a total of four half-turn windings or can be considered as two pairs of half-turn windings. As will be seen in FIG. 4, the center-tap terminal legs $2_B$ and $2_A$ are connected together to form a common output line designated $20_T$.

Again referring to FIG. 1, a second insulator tube, $12_b$, is placed around the secondary conductor $13_B$. Around insulator $12_b$ is then placed around secondary conductor $13_A$ which likewise has a center-tap terminal leg $2_A$ and first and second electrical output terminal legs $1_A$ and $3_A$ which are separated by a slit $14_A$. As previously mentioned, instead of the slit $14_A$ occurring as shown, the legs $1_A$ and $3_A$ may overlap as long as suitable insulation is placed to keep them electrically separate.

The secondary conductors $13_B$ and $13_A$ are placed in a special relationship in regard to their orientation to each other and around the central core leg $10_c$. The secondary conductor $13_A$ is transversly oriented 180° about its longitudinal axis with regard to the position of the secondary conductor $13_B$. Thus, as seen in FIG. 2, the two center-tap terminal legs $2_B$ and $2_A$ extend outward from the transformer in the same direction but extend 180° apart with respect to the longitudinal axis of the center leg $10_c$.

Likewise, in FIG. 1, it will be seen that, extending in the opposite direction are the two output terminal legs $1_B$, $3_B$ of the secondary conductor $13_B$ and these legs in extension are paralleled by the extending terminal legs $1_A$ and $3_A$ of the secondary conductor $13_A$. Again, the orientation of the terminal legs $1_B$, $3_B$ is 180° opposite from terminal legs $1_A$, $3_A$ in relationship to the longitudinal axis of central leg $10_c$.

An insulating wrapper or tube $12_c$ (FIG. 1) surrounds the secondary conductor $13_A$ and the remaining half of the primary turns 6 (as represented from point $6_p$ to point $7_p$) are then wound in the conventional fashion over the insulation $12_c$. The connection at $7_p$ (FIG. 1, FIG. 2 and FIG. 4) is made so that the windings 5 and 6 of each half of the primary are connected in series aiding relationship. The inputs of the full primary winding are shown at points $5_p$ and $6_p$.

Figure 2:
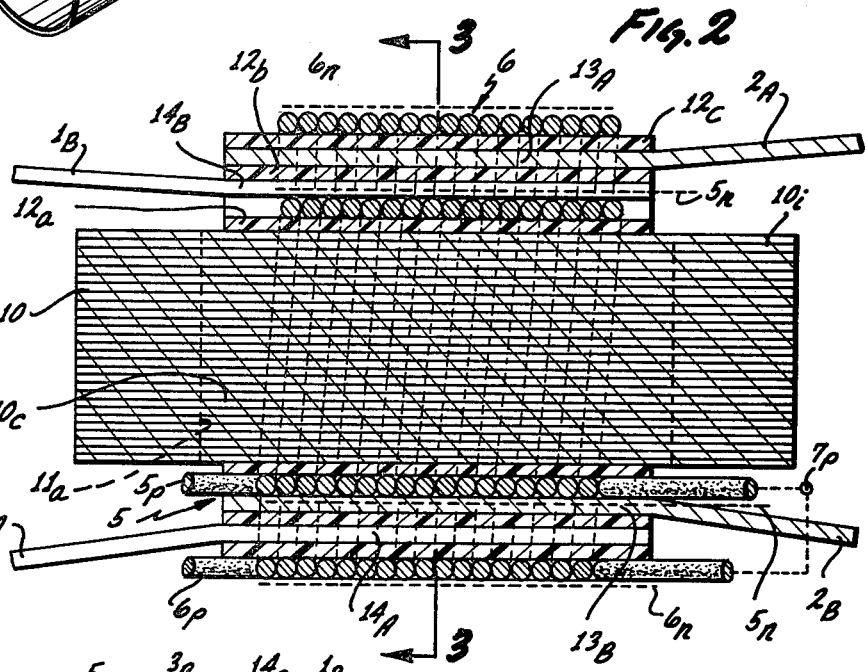
FIG. 2 is a cross-sectional view along the line 2—2 of FIG. 1 showing the relative positions of the three legs in relationship to primary and secondary windings.

Referring to FIG. 2 and FIG. 1, there is seen a cross-section of the transformer assembly of FIG. 1 along the lines 2—2. The central leg $10_c$ is covered by insulating envelope $12_a$. Around this, there is wound the first half of the primary winding 5 and its insulation $5_n$. The secondary conductor $13_B$ encompasses this winding and its terminal legs $1_B$, $3_B$ extend in one direction and its center-tap leg $2_B$ extends in the opposite direction. Insulation envelope $12_b$ encompasses the secondary conductor $13_B$. The secondary conductor $13_A$, which is encompassed by the insulation envelope $12_c$, surrounds the entire assembly around central leg $10_c$. The second half of the primary winding 6 then winds about the subordinate assemblies. The secondary conductor $13_A$ has its terminal center-tap leg $2_A$ extending outward in the same direction as leg $2_B$ (of secondary conductor $13_B$) for easy connection of these two center-tap legs.

In each case it will be noted that the legs $2_A$ and $2_B$ are 180° apart in orientation around the central axis of the central leg $10_c$; likewise, the terminal legs $1_B$, $3_B$ are 180° oriented from legs $1_A$ and $3_A$.

Figure 3:
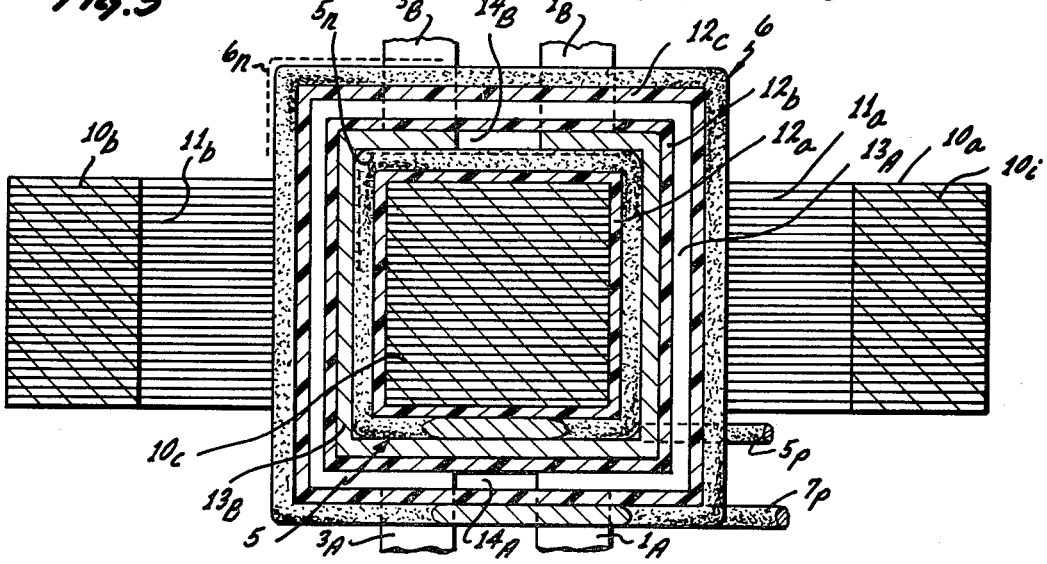
FIG. 3 is a cross-section view along line 3—3 of the transformer of FIG. 2.

FIG. 3 shows a cross-sectional cutout of FIG. 2 along the lines 3—3. Again, the central leg $10_c$ is shown encompassed by: the insulator $12_a$, the first half of the primary winding 5 which is in itself an insulated winding, the secondary conductor envelope $13_B$, the insulating envelope $12_b$, the secondary conductor envelope $13_A$ and its insulating envelope $12_c$ which is encompassed by the second half of the primary winding 6.

Figure 1D:
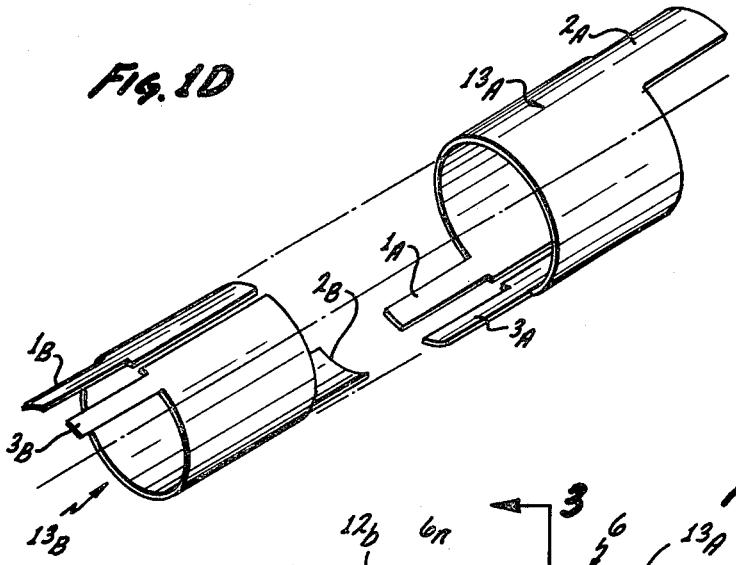
FIG. 1D illustrates a brother-pair of cylindrical secondary conductors.

In FIGS. 1, and 1D, there is shown secondary conductors of rectangular cross-section and circular cross-section. FIGS. 1A, B, and C show another embodiment of useful secondary conductors formed of spiral-turned strips.

In FIG. 1A, a secondary conductor is formed of two copper strips $20_{tl}$ and $20_{tr}$ which have insulated coverings 22 and non-insulated ends $24_{t1}$, $24_{t2}$, $25_{tl}$ and $25_{tr}$. Viewing FIG. 1A along center line C—C from left to right, the strip $20_{tl}$ turns spirally counterclockwise while strip $20_{tr}$ turns clockwise. The non-insulated edges $24_{t1}$ and $24_{t2}$ are connected electrically to form the center-tap terminal. The opposite edges $25_{tl}$ and $25_{tr}$ are separated by insulation to make two output terminals which form two half-turn windings around the center-tap terminal.

As seen in FIGS. 1A and 1B, another set of strips $21_{bl}$ and $21_{br}$ are similarly formed but placed in a transverse 180° orientation to the first set of strips. Thus strips $21_{bl}$, $21_{br}$ are located within, but insulated from, strips $20_{tl}$, $20_{tr}$ to compose a pair of secondary half-turn conductors. Strips $21_{bl}$, $21_{br}$ have a center-tap terminal formed of connecting edges $24_{b1}$, $24_{b2}$ are likewise have two output terminals $25_{bl}$ and $25_{br}$.

FIG. 1C shows a cross-section of FIG. 1B along line 1C—1C to indicate how spiral strips $20_{tr}$, $20_{tl}$ encompass strips $21_{bl}$, $21_{br}$.

Figure 4:
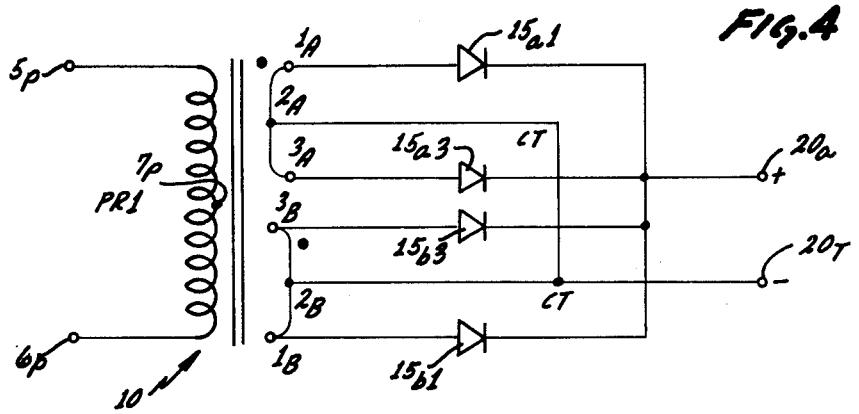
FIG. 4 is an electrical schematic drawing of a power supply showing how the elements of FIGS. 1 and 2 are electrically arranged in order to provide a full wave rectified power supply.

Referring to FIG. 4, there is seen a schematic electrical drawing illustrating the connective relationships applied to the elements of FIGS. 1, 2 and 3. The primary input terminals $5_p$ and $6_p$ are wound in two portions 5 and 6 (separated by the center connecting point $7_p$) around the E-I core 10 to provide a magnetic flux in the E-I core which will induce voltages into the secondaries of the transformer. The secondary conductor $13_A$ provides two half-turn secondary windings, $1_A$–$2_A$ and $2_A$–$3_A$. Likewise, the secondary conductor $13_B$ provides two half-turn windings $1_B$–$2_B$ and $2_B$–$3_B$.

In FIG. 4 the two center-tap terminal legs $2_A$ and $2_B$ are connected electrically to form a negative output terminal $20_T$. The output voltage terminal legs $1_A$, $3_A$, $3_B$ and $1_B$ are respectively connected to diode rectifiers $15_{a1}$, $15_{a3}$, $15_{b3}$ and $15_{b1}$. The positive output of these rectifiers are commonly connected in order to form a positive output terminal $20_A$.

Operationally, the voltage induced in the half-turn secondary $1_A$–$2_A$ is in a supporting phase with the voltage of the other half-turn secondary $2_B$–$3_B$; similarly, on the next half cycle, the voltage developed across half-turn secondary $2_A$–$3_A$ will be in phase with half-turn secondary $1_B$–$2_B$ in order to generate a second half cycle of current in a second supporting phase relationship.

Thus the half-turn transformer assembly of FIG. 4 can be combined with diode rectification elements and connected to provide a positive and negative terminal developing a DC output which has very large current capacity at a low voltage.

Figure 5:
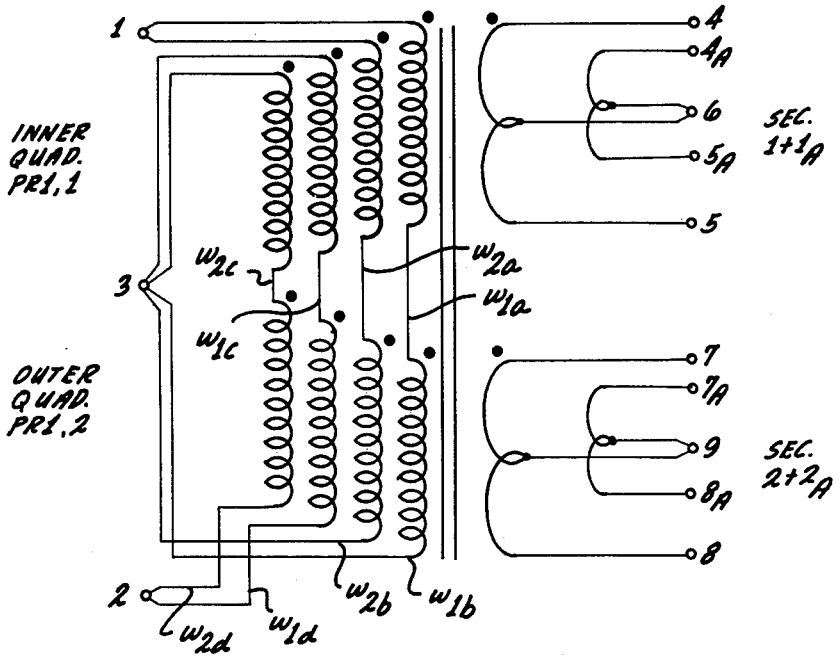
FIG. 5 shows a power supply embodiment whereby four secondary conductors are used to form 8 half-turn windings on the central core-leg.

FIG. 5 shows an electrical schematic of an embodiment whereby four "brother-pairs" of secondary conductors are used to provide a total of eight half-turn secondary windings. Secondary conductors of the types of configurations shown in FIGS. 1, 1A, 1B and 1C may be used in combination with a plurality of split primary windings shown in FIG. 5.

In FIG. 5 the major primary input terminals 1 and 2 provide the input voltage to two sets of primary windings which are portioned into four separate sectional winding areas which would be distributed around the center leg $10_c$ of FIG. 1 and whereby each portion of the primary winding would encompass a different level similar to that shown in FIGS. 1 and 2.

Thus, the first primary winding has four portions designated as $W_{1a}$, $W_{1b}$, $W_{1c}$ and $W_{1d}$. The second parallel connected primary winding is also seen to have four sections $W_{2a}$, $W_{2b}$, $W_{2c}$ and $W_{2d}$.

The four secondary conductors of the embodiment of FIG. 5 will provide eight half-turn secondaries which may be used advantageously to provide even greater volumes of current capacity while maintaining the low voltage required for many computer and industrial applications. Thus the eight half-turn secondary outputs may be designated as follows:

| SECONDARY #1 | SECONDARY #1A |
|---|---|
| 4–6 | 4A–6 |
| 5–6 | 5A–6 |

-continued

| SECONDARY #2 | SECONDARY #2A |
|---|---|
| 7-9 | 7A-9 |
| 8-9 | 8A-9 |

These terminal designations indicate the eight half-turn secondary windings provided by the transformer of FIG. 5. The transformer assembly of FIG. 5 could be used with rectifier diodes or with switching inverters in order to provide a power supply of unusually high current delivery capacity while maintaining a suitable low voltage regulated DC output level.

Operationally, many advantages proceed from the above-described configurations. For example, in FIG. 4, it will be seen that if equal currents are carried from terminal $1_A$ and terminal $3_B$, then we have equal return flux through each outer leg ($10_a$, $10_b$) of the magnetic core. Then on the opposite half-cycle, if equal currents are carried off from terminals $1_B$ and $3_A$, again the balanced core flux requirements are met.

Since the two "half-turn secondaries" work to balance the flux around the two outer legs of the magnetic core, then the parallel-connected diodes of FIG. 4 will tend to carry equal amounts of current and thus permit the diodes to be operated at full ratings without introducing problems of derating the diodes for diode current unbalance.

The embodiment show in FIG. 5 having four secondary conductors to provide eight half-turn output windings may be used to provide, for example, a two volt DC regulated output with a current capacity of over 400 amperes.

Another winding configuration of the above transformer assembly could be accomplished by winding the primary half-sections 5 and 6 of FIG. 1 around the outer legs $10_a$ and $10_b$ while reserving the central leg $10_c$ for the secondary conductors, such as $13_b$ and $13_a$ of FIG. 1. This type of configuration using the outer legs for primary winding would be useful in manufacturing and assembly and for economy of spatial volume. However, the leakage inductance would be somewhat higher in this case than in the case of the embodiment wherein the primary windings and their portions 5 and 6 are wound in stages around the central core-leg $10_c$.

Another embodiment in which the present invention may be advantageously incorporated is in power supplies using switching converters. The use of switching converters in conjunction with transformers and rectifiers is described in considerable detail U.S. Pat. No. 4,024,450 entitled "Power Transistor Switching Circuit" and U.S. Pat. No. 4,032,830 entitled "Modular Constant Current Power Supply" by inventor Carlos E. Buonavita, both of which patents are assigned to the same assignee as that of the present application. These two patents are deemed to be herein included by reference.

Figure 6:
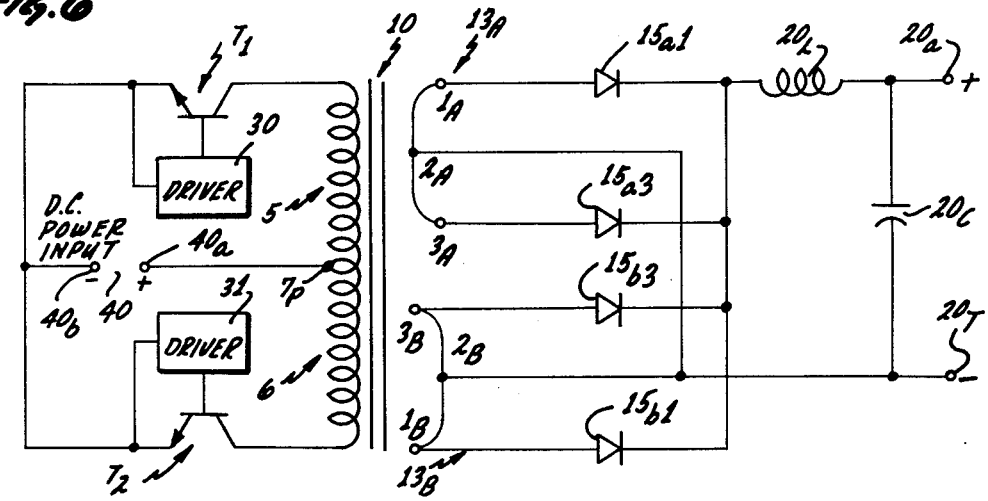
FIG. 6 is a schematic drawing of a power supply showing the use of a switching inverter with the half-turn transformer and its secondary conductors.

A preferred embodiment of a switching inverter power supply employing specialized half-turn secondary conductors is shown in FIG. 6. The primary winding of transfomer 10 is halved into two portions 5 and 6. A direct current power input 40 is applied to terminals $40_a$ and $40_b$. This applies a voltage from the center $7_p$ of the primary winding to a first power switching transistor $T_1$ and a second power switching transistor $T_2$. In the particular transistor configuration shown, the emitter of each transistor is connected to the negative DC input terminal $40_b$ while the collector of each transistor is connected to each end of the primary winding. Between the base and emitter of each transistor there is connected a driver shown as driver 30 for transistor $T_1$ and driver 31 for transistor $T_2$. The drivers 30 and 31 are used to switch the transistors $T_1$ and $T_2$. Such types of drivers are known in the art and are described in publications from TRW Power Semi-Conductors Division of TRW, Inc., Lawndale, Calif., 90260 and designated as Application Note Number 120 (1-75) and Applications Note 122 (2-75). The switching frequency may be of the order of 20,000 Hertz.

The secondary of transformer 10 is made of two envelopes forming secondary conductors $13_A$ and $13_B$. Each of these envelopes provide two half-turn secondary windings whereby half-turn winding $1_A$–$2_A$ works in supportive phase with half-turn winding $3_B$–$2_B$. Likewise, the half-turn winding $3_A$–$2_A$ works in supportive phase relationship with $1_B$–$2_B$ on the alternate phases.

Terminals $2_A$ and $2_B$ are the center-tap terminal legs which are connected together to provide a negative output terminal $20_T$. Diode rectifiers $15_{a1}$, $15_{a3}$, $15_{b3}$, $15_{b1}$ have their positive outputs connected in common to form the positive output terminal $20_a$. A smoothing filter composed of inductor $20_L$ and capacitor $20_C$ helps to regulate and maintain the output voltage of the power supply.

Due to the high frequency operation of the switching transistors, the amount of magnetic flux density required to be carried by the E-I transformer core 10 is considerably reduced, thus permitting economies in the amount of core material required. At the same time, since the half-turn windings are very accurately balanced because of the nature of their configuration, then equal amounts of voltage and current will be applied equally to each of the diode rectifiers such that there is no need for derating of the rectifiers used since they work under balanced conditions.

The type of transistors which may be used for $T_1$ and $T_2$ may preferably be of the Darlington type of NPN. However, other types of transistors and switching devices may also be used.

It may further be noted that because of the balanced operation of the primary and the balanced operation of the secondaries, there is no DC current component, enabling a minimal amount of leakage inductive reactance to provide a optimum configuration economically usable for power supplies requiring delivery of low voltage and high current delivery capabilities.

I claim:

1. An electrical conductor apparatus for encompassing a magnetic field comprising:

(a) a first pair of spiral shaped electrical strip conductors which are aligned along the longitudinal axis of said magnetic field, and wherein a first one of said conductors spirals clockwise and the other conductor spirals counterclockwise around said axis of said magnetic field, (b) a second pair of spiral shaped conductors longitudinally aligned along said axis of said magnetic field and wherein a first one of said conductors spirals clockwise and a second one of said conductors spirals counterclockwise around said axis of said magnetic field, (c) and wherein each of said pair of spiral conductors is insulated from the other and electrically connected such that each spiral pair of conductors forms a balanced pair of half-turn windings via output terminals at one end relative to a center tap at the opposite end which electrically connects said pair of spiral conductors.

2. An electrical conductor apparatus for encompassing a magnetic field running therethrough and forming two half-turn circuits relative to a center-tap terminal, said conductor apparatus comprising:

(a) a first electrically conducting envelope encompassing said magnetic field, said envelope having a longitudinal slit dividing said envelope symmetrically into two sections, said envelope including:

(a1) an electrically conductive center-tap terminal located at a point 180° from said longitudinal slit and residing equidistant from said slit measured along either one of said two sections;

(a2) a first and a second electrical output terminal located respectively on each side of said longitudinal slit at the same end thereof;

(b) a second electrically conducting envelope which symmetrically duplicates said first envelope and has a longitudinal slit dividing said envelope symmetrically into two sections, said second envelope including:

(b1) an electrically conductive center-tap terminal located at a point 180° from said longitudinal slit and residing equidistant from said slit measured along either one of said two sections;

(b2) a first and second electrical output terminal located respectively on each side of said longitudinal slit at the same end thereof;

(c) wherein said second envelope encompasses said first envelope concentrically and the envelopes are insulated from each other while being oriented such that the longitudinal slit of said first envelope is located 180° from the said longitudinal slit of said second envelope.

3. The conductor apparatus of claim 2 wherein said first and second envelopes form a brother-pair of envelopes which encompass approximately the same cross section area of magnetic field passing therethrough.

4. The conductor apparatus of claim 3 wherein said brother-pair of envelopes include a common electrical connection between the center-tap terminals of said first and second envelopes.

5. The conductor apparatus of claim 3 wherein each of said envelopes is formed of a hollow tube of rectangular cross-section and said second envelope is of a slightly larger cross-section than said first envelope to provide insulative separation from said first envelope.

6. The conductor apparatus of claim 3 wherein each of said envelopes is formed of a hollow tube of circular cross-section and said second envelope is of a slightly larger cross-section than said first envelope to provide insulative separation therefrom.

* * * * *

UNITED STATES PATENT AND TRADEMARK OFFICE

CERTIFICATE OF CORRECTION

PATENT NO. : 4,176,335

DATED : November 27, 1979

INVENTOR(S) : Douglass E. Charpentier

It is certified that error appears in the above-identified patent and that said Letters Patent are hereby corrected as shown below:

Col. 1, line 68, change "the" first occurrence to --one--.

Col. 2, line 7, change "operation" to --operating--;
line 22, change "with" to --within--;
line 25, change "dislcosed" to --disclosed--;
line 39, change "spaced" to --space--.

Col. 4, line 53, change "around" second occurrence to --another--.

col. 7, line 29, change "show" to --shown--.

Signed and Sealed this

*Eighteenth* Day of *March 1980*

[SEAL]

*Attest:*

SIDNEY A. DIAMOND

*Attesting Officer*

*Commissioner of Patents and Trademarks*